US006634175B1

(12) United States Patent
Kawata et al.

(10) Patent No.: US 6,634,175 B1
(45) Date of Patent: Oct. 21, 2003

(54) GAS TURBINE AND GAS TURBINE COMBUSTOR

(75) Inventors: Yutaka Kawata, Takasago (JP); Shigemi Mandai, Takasago (JP); Yoshiaki Tsukuda, Takasago (JP); Eiji Akita, Takasago (JP); Hisato Arimura, Takasago (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/762,598

(22) PCT Filed: Jun. 8, 2000

(86) PCT No.: PCT/JP00/03716

§ 371 (c)(1),
(2), (4) Date: Feb. 9, 2001

(87) PCT Pub. No.: WO00/75573

PCT Pub. Date: Dec. 14, 2000

(30) Foreign Application Priority Data

Jun. 9, 1999 (JP) ..... 11-162520

(51) Int. Cl.[7] ..... F23R 3/10; F23R 3/16; F23R 3/54

(52) U.S. Cl. ..... 60/746; 60/747; 60/760

(58) Field of Search ..... 60/737, 746, 747, 60/748, 760

(56) References Cited

U.S. PATENT DOCUMENTS

| | | | | | |
|---|---|---|---|---|---|
| 3,233,866 | A | * | 2/1966 | Davidovic | 60/760 |
| 3,589,128 | A | * | 6/1971 | Sweet | 60/760 |
| 4,428,191 | A | * | 1/1984 | Lane et al. | 60/746 |
| 4,455,839 | A | * | 6/1984 | Wuchter | 60/747 |
| 5,121,597 | A | * | 6/1992 | Urushidani et al. | 60/747 |
| 5,660,045 | A | * | 8/1997 | Ito et al. | 60/747 |
| 5,836,164 | A | * | 11/1998 | Tsukahara et al. | 60/747 |
| 6,082,111 | A | * | 7/2000 | Stokers | 30/746 |
| 6,158,223 | A | | 12/2000 | Mandai et al. | |

FOREIGN PATENT DOCUMENTS

| | | |
|---|---|---|
| JP | 7-198143 | 8/1995 |
| JP | 8-135969 | 5/1996 |
| JP | 9-184630 | 7/1997 |
| JP | 11-72230 | 3/1999 |
| JP | 11-141878 | 5/1999 |

* cited by examiner

*Primary Examiner*—Ted Kim
(74) *Attorney, Agent, or Firm*—Wenderoth, Lind & Ponack, L.L.P.

(57) ABSTRACT

A gas turbine combustor has homogenous air inflow by elimination of turbulence from the air, reducing combustion instability. A combustor 3 has, at its center, a pilot nozzle 8 and eight main nozzles 7 around the pilot nozzle 8. The air flows in around the individual nozzles 7 and 8 to the leading end of the combustor 3 so that it is used for combustion. An annular flow ring 20, having a semicirculat section, is disposed at the upstream end portion of a combustion cylinder 10, and a porous plate 50 and a surrounding rib 51 are disposed downstream of the flow ring 20. The air inflow is smoothly turned at first by the flow ring 20 and then straightened by the porous plate 50 so that the air flows without any disturbance around the individual nozzles 7 and 8 to the leading end, thereby reducing combustion instability.

6 Claims, 15 Drawing Sheets

$V_{max}0 > V_{max}1 > V_{max}2$

GAS TURBINE AND GAS TURBINE COMBUSTOR

TECHNICAL FIELD

The present invention relates to a gas turbine combustor and to a structure for reducing the disturbances in an air flow in the combustor so that the combustion instability may be reduced.

BACKGROUND ART

FIG. 13 is a general sectional view of a gas turbine. In FIG. 13, numeral 1 designates a compressor for compressing air for combustion and for cooling a rotor and blades. Numeral 2 designates a turbine casing, and numeral 3 designates a number of combustors arranged in the turbine casing 2 around the rotor. There are for example sixteen combustors, each of which is constructed to include a combustion cylinder 3*a,* a cylinder 3*b* and a transition cylinder 3*c*. Numeral 100 designates a gas path of the gas turbine, which is constructed to include multistage moving blades 101 and stationary blades 102. The moving blades are fixed on the rotor and the stationary blades are fixed on the side of the turbine casing 2. The hot combustion gas, jetting from the combustor transition cylinder 3*c,* flows in the gas path 100 to rotate the rotor.

FIG. 14 is a detailed view of portion 3*a* in FIG. 13 and shows the internal structure of the combustor 3. In FIG. 14, numeral 4 designates an inlet passage of the combustor, and numeral 5 designates a main passage or a passage around main nozzles 7. A plurality of, e.g., eight main nozzles 7 are arranged in a circle. Numeral 6 designates a main swirler which is disposed in the passage 5 of the main nozzles 7 for swirling the fluid flowing in the main passage 5 toward the leading end. Numeral 8 designates one pilot nozzle, which is disposed at the center and which is provided therearound with a pilot swirler 9, as in the main nozzles 7. Numeral 10 designates a combustion cylinder.

In the gas turbine combustor thus far described, the air, as compressed by the compressor 1, flows, as indicated by 110, from the compressor outlet into the turbine casing 2 and further flows around the inner cylinder of the combustor into the combustor inlet passage 4, as indicated by 110*a*. After this, the air turns around the plurality of main nozzles 7, as indicated by 110*b,* and flows into the main passage 5 around the main nozzles 7, as indicated by 110*c*. On the other hand, the air also flows around the pilot nozzle 8, as indicated by 110*d,* and is swirled by the main swirler 6 and the pilot swirler 9 until it flows to the individual nozzle leading end portions, as indicated by 110*e,* for combustion.

FIG. 15 is a diagram showing the flow states of the air having flowed into the combustor of the prior art. The air 110*a* from the compressor flows, as indicated by 110*b,* around the main nozzles 7. Around the outer sides of the main nozzles 7, however, vortexes 120 are generated by the separation of the flow. When the air flows in from the root portion around the pilot nozzle 8, on the other hand, there are generated vortexes 121, vortexes 122 flowing to the leading end of the pilot nozzle 8, and disturbances 123 in the flow around the outlet of the inner wall of the combustor.

In this gas turbine, NOx is emitted more as the load becomes heavier, but this emission has to be suppressed. As the load is increased, the combustion air has to be increased accordingly. As described with reference to FIG. 15, the air vortexes 120, 121, 122 and 123 in the combustor are more intensified, increasing the tendency to combustion instability. In order to suppress the emissions of NOx, the aforementioned combustion instability is reduced at present by adjusting the pilot fuel ratio and the bypass valve opening. With the prevailing structure, however, the running conditions are restricted by the combustion instability.

In the gas turbine combustor of the prior art, as has been described hereinbefore, drifts, vortexes and flow disturbances are caused in the air flowing in the combustor, causing the combustion instability. As the load is increased, increasing the flow rate of air to combustion, so that the drifts, vortexes and flow disturbances have serious influences, the concentration of the fuel becomes heterogeneous with respect to time and space, thereby making the combustion unstable. At present, in order to suppress this combustion instability, the pilot combustion ratio and the bypass valve opening are adjusted, but in vain for sufficient combustion stability. In the worst case, therefore, the combustor is damaged and the gas turbine running range is restricted.

SUMMARY OF THE INVENTION

Therefore, the present invention has been conceived to provide a gas turbine combustor which reduces combustion instability by guiding the air to flow smoothly into the combustor and by straightening the flow to eliminate flow disturbances and concentration changes of the fuel.

In order to solve the foregoing problems, the present invention contemplates the following.

(1) A gas turbine combustor comprises a cylinder supported at its circumference by a plurality of struts fixed on one end in a combustor housing portion of a turbine casing. A pilot nozzle is arranged at the center of the cylinder. A plurality of main nozzles are arranged around the pilot nozzle. A flow ring has a ring shape so as to cover the upstream end of the cylinder, a semicircular sectional shape (including an elliptical shape) and so maintains a predetermined gap. A porous plate downstream of the flow ring closes a space which formed in the cylinder between the pilot nozzle and the main nozzles.

(2) A gas turbine combustor as set forth in (1), can have the flow ring sectionally shaped as an extended semicircular shape by extending the two ends of a semicircle. The porous plate is fixed at its circumference on the circumferential side face of the extended semicircular shape.

(3) A gas turbine combustor as set forth in (1), can have the flow ring include semicircular curves arranged in multiple stages while maintaining a predetermined gap.

(4) A gas turbine combustor as set forth in (1), can have a guide portion disposed around the inlet portion of the combustor housing portion of the turbine casing with a smoothly curved face for covering the whole circumference wall face of the inlet portion.

(5) A gas turbine combustor as set forth in (1), can also have a funnel shaped flow guide having a smoothly curved sectional shape along the curved face of the flow ring and arranged upstream of the flow ring while maintaining a predetermined gap from the flow ring. The flow guide is fixed at its larger diameter portion on the inner wall of the combustor housing portion of the turbine casing and at its smaller diameter portion around the pilot nozzle. The porous plate is arranged downstream of a support for supporting the pilot nozzle and the main nozzles.

(6) A gas turbine combustor according to the present invention may also comprise a cylinder supported at its circumference by a plurality of struts fixed on one end in a combustor housing portion of a turbine casing. A pilot nozzle is arranged at the center of the cylinder. A plurality of main nozzles are arranged around the pilot nozzle. A flow ring having a ring shape covers the upstream end of the cylinder, has a semicircular sectional shape and maintains a predetermined gap. Flow rings individually having semicircular sectional shapes are arranged in multiple stages upstream of the flow ring in the axial direction while maintaining a predetermined gap. A cylindrical porous plate covers the entire circumference of the inlet portion on the outer side of all of the flow ring.

(7) Another gas turbine combustor may comprise a pilot nozzle arranged at the center of a cylinder and a plurality of main nozzles arranged around the pilot nozzle. Spaces between the circumference of the pilot nozzle and the inner circumferences of the individual main nozzles confronting each other are filled with a filler in the axial direction downstream from the upstream end so as to extend near the circumferential portion of the leading end of the cylinder, thereby forming fairings. The passage between the adjoining fairings is made wider on the downstream side than on the upstream side.

(8) Another gas turbine may comprise a compressor and a combustor, the combustor comprising a cylinder supported at its circumference by a plurality of struts fixed on one end in a combustor housing portion of a turbine casing. A pilot nozzle is arranged at the center of the cylinder and a plurality of main nozzles are arranged around the pilot nozzle. A flow guide is disposed around the entire circumference of the outlet of the compressor, having a smoothly curved face for guiding the discharged air to flow toward the combustor on the outer side. The combustor comprises a flow ring having a ring shape so as to cover the upstream end of the cylinder with a semicircular sectional shape and so as to maintain a predetermined gap. A porous plate is arranged downstream of the flow ring for closing a space which is formed in the cylinder between the pilot nozzle and the main nozzles. A guide portion has a smooth curved face and is disposed around the inlet portion of the combustor housing portion of the turbine casing for covering the entire circumference wall face of the inlet portion.

In the invention (1), the air to flow in the combustor flows at first smoothly along the curved face of the flow ring in the cylinder and then passes through the numerous pores of the porous plate so that it is straightened into a homogenous flow. With neither separation vortexes nor flow disturbances, unlike the prior art, the air flows along the pilot nozzle and the main nozzles to the leading end portion so that combustion instability, as might otherwise be caused by the concentration difference of the fuel, can be reduced.

In the invention (2), the flow ring is formed into an extended semicircular shape, and the porous plate can be fixed at its periphery on the extended semicircular side face so that manufacture can be facilitated. In the invention (3), on the other hand, the flow rings are arranged in multiple stages so that the air is homogeneously guided to flow into the cylinder of the combustor through the multistage circumferential gaps to thereby better promote the effects of invention (1).

In the invention (4), the inlet portion of the combustor housing portion for the air is constructed of the wall faces having corners for protruding into the housing portion. The air to flow into the combustor is disturbed and is guided in a turbulent state into the flow guide of the leading end portion of the combustor. However, the guide portion is provided so that the wall face of the inlet portion may form a smoothly curved face. With this guide portion, the air inflow can be prevented from being disturbed, reducing the combustion instability as with invention (1).

In the invention (5), the air inflow is smoothly turned at the upstream end of the combustor by the funnel-shaped flow guide and is guided into the cylinder by the flow ring. Moreover, the porous plate is disposed downstream of the support for supporting the pilot nozzle and the main nozzles. Even if the flow is more or less disturbed by the support therefore, these disturbances are straightened by the porous plate so that the air flow is homogenized and introduced into the nozzle leading end portion to thereby better ensure the reduction of combustion instability.

In the invention (6), the flow rings are arranged in multiple stages, and the cylindrical porous plate is arranged in front of the air inlet portion around those flow rings. Therefore, the air to flow into the combustor is straightened into cylindrical homogeneous flow by the porous plate. This homogeneous flow is then smoothly guided through the gap between the multistage flow rings into the cylinder of the combustor. In the invention (6), too, the disturbances of the air flow are reduced to reduce the combustion instability.

In the invention (7), in the space between the individual main nozzles and the pilot nozzle opposed to each other, the fairings are formed so that the air flows in the gaps between the adjoining fairings and further flows downstream. This air flow has a downward rising flow velocity. Therefore, the gap is enlarged from upstream to downstream so that the air flow through the fairings is homogenized by the shape. Thus, the air can flow downstream without any flow disturbance to thereby reduce combustion instability as might otherwise be caused by its disturbance.

In the invention (8), the flow guide is disposed at the compressor outlet for guiding the air flow from the compressor outlet to the combustor homogeneously around the combustor. In the combustor, the flow ring and the porous plate are disposed to eliminate the air disturbances in the combustor and to reduce combustion instability. Moreover, the air to flow in the combustor is guided to flow smoothly at the inlet portion of the combustor housing portion by the guide portion of the smooth curve. As a result, there can be realized a gas turbine which can reduce the pressure loss in the air flow and can reduce combustion instability.

DESCRIPTION OF THE PREFERRED EMBODIMENTS

Figure 1:
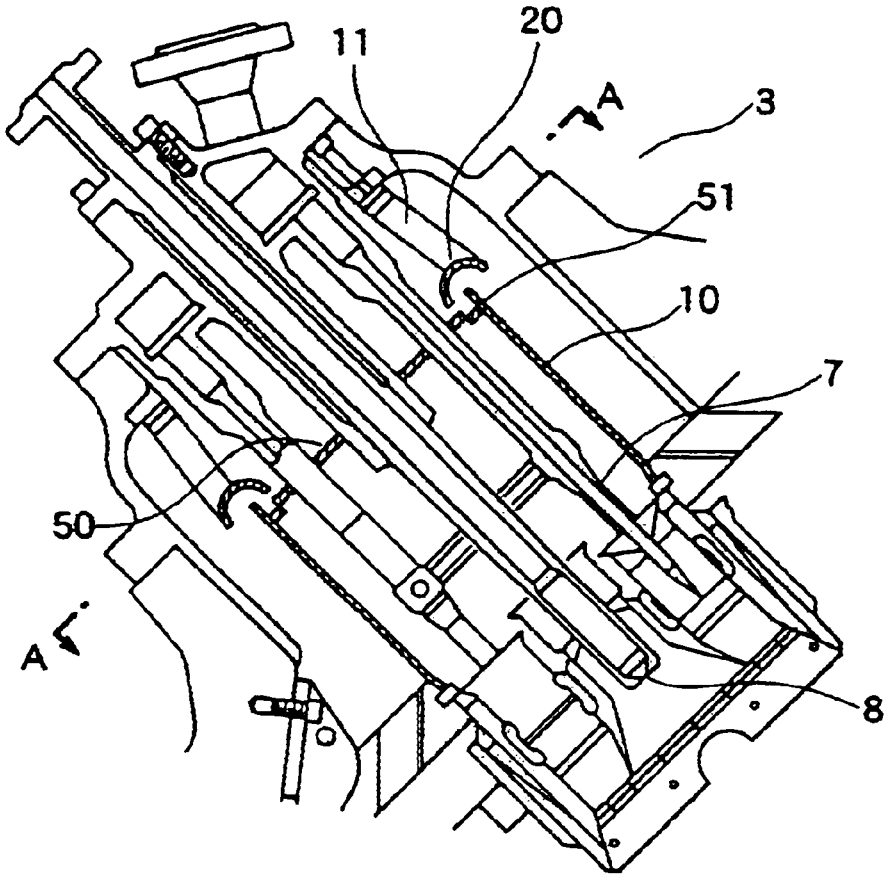
FIGS. 1(*a*)–(*d*) show a gas turbine combustor according to a first embodiment of the invention, where FIG. 1(*a*) is a sectional view, FIG. 1(*b*) is a sectional view taken along line A—A in FIG. 1(*a*), FIG. 1(*c*) is a sectional view taken along line B—B in FIG. 1(*b*), and FIG. 1(*d*) is an application example of (c).
Figure 1:
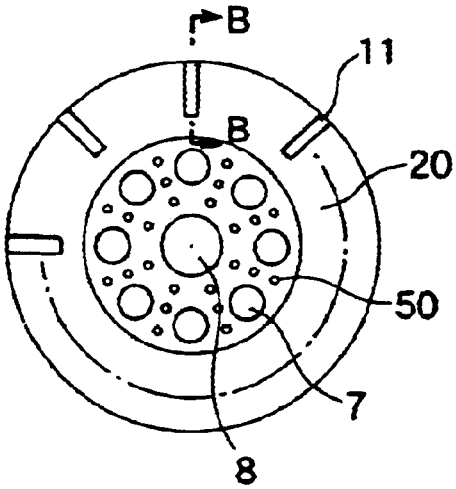
Figure 1C:
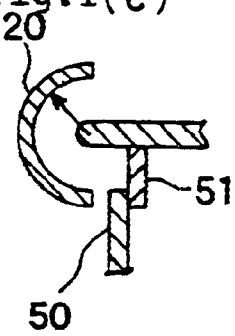
Figure 1D:
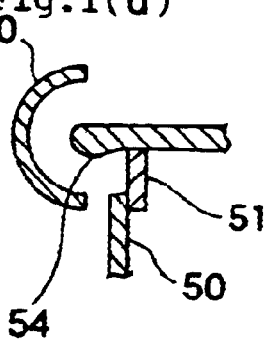
Figure 14:
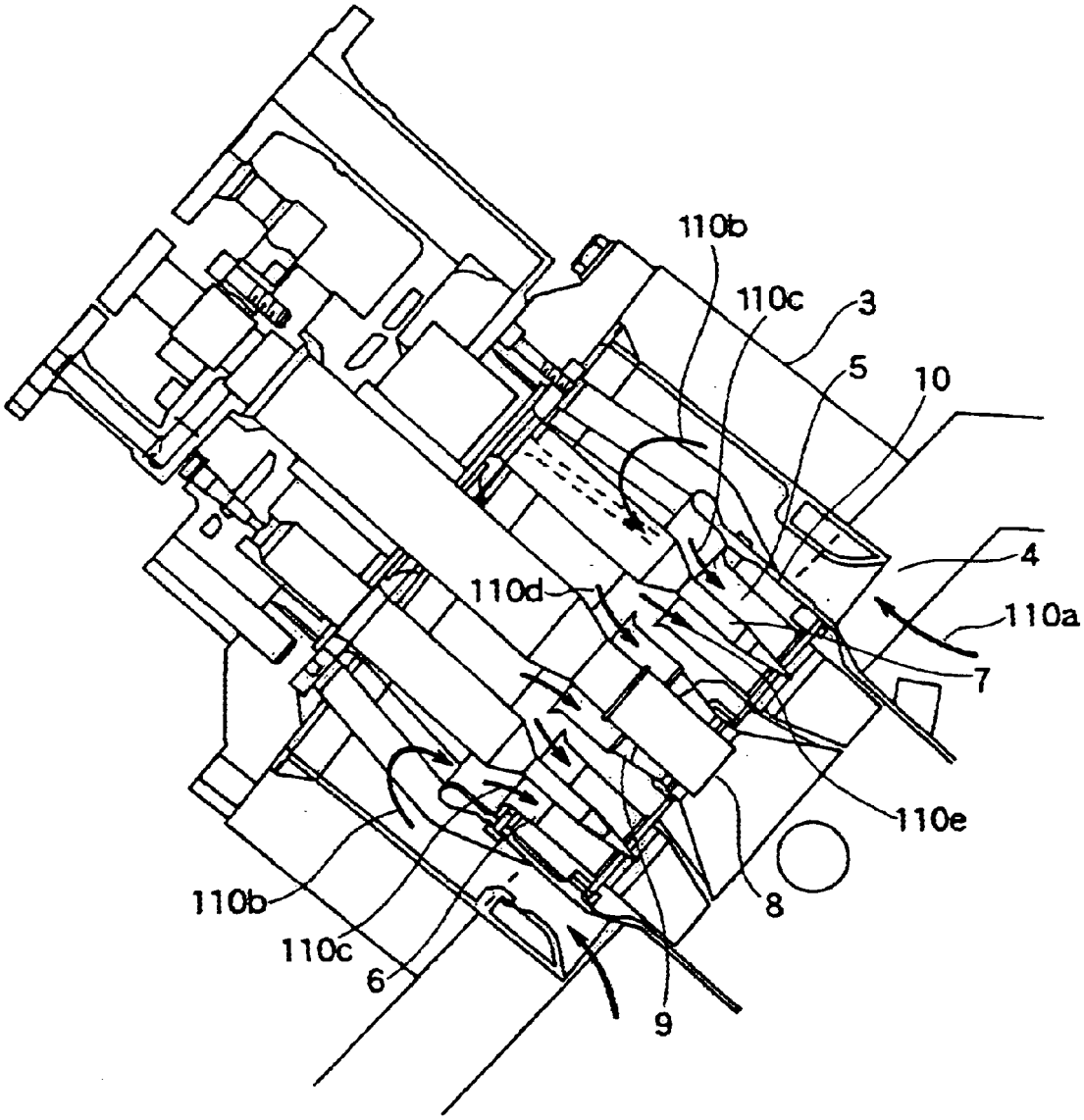
PRIOR ART Fig. 14
FIG. 14 is a detailed view of portion G in FIG. 13.
Figure 15:
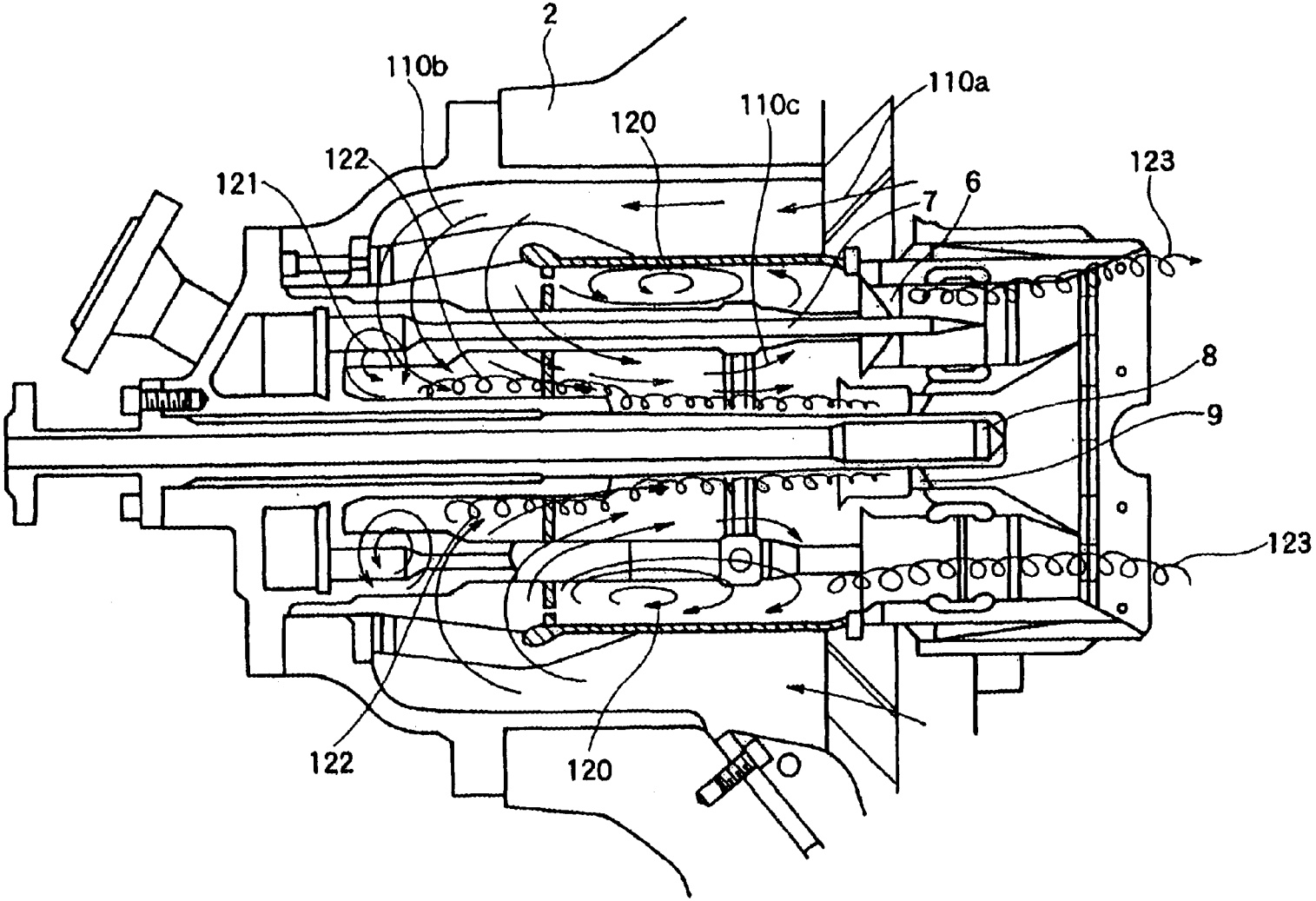
Fig. 15 PRIOR ART
FIG. 15 is a diagram showing air flows of a gas turbine combustor of the prior art.

Embodiments of the invention will be specifically described with reference to the accompanying drawings. FIGS. 1(*a*)–(*d*) show a gas turbine combustor according to a first embodiment of the invention, wherein FIG. 1(*a*) is a sectional view of the inside, FIG. 1(*b*) is a sectional view taken along line A—A in FIG. 1(*a*), FIG. 1(*c*) is a sectional view taken along line B—B in FIG. 1(*b*), and FIG. 1(*d*) is a modification of FIG. 1(*c*). In these Figures, the structure of the combustor is identical to that of the prior art example shown in FIG. 14, and portions of the invention will be mainly described by quoting common reference numerals.

In FIG. 1, numeral 20 designates a flow ring which has a ring shape with a semicircular section and which is mounted by struts 11 so as to cover, in a semicircular shape, the end portion of a combustion cylinder 10. The flow ring 20 is formed into a circular annular shape by splitting a tube of an internal radius R longitudinally into halves, as shown at (c).

Close to the end portion of the flow ring 20, there is arranged a porous plate 50 which is provided with a number of pores to have an opening ratio of 40% to 60%. This opening ratio is expressed by a/A, with the area of the porous plate designated by A and the total area of the pores is designated by a. Numeral 51 designates a porous plate rib which is disposed at the end portion over all of the circumference of the inner wall of the combustion cylinder 10, as shown at FIGS. 1 (*c*) and (*d*). This rib 51 is made smaller than the porous plate 50 so that the nozzle assembly may be extracted from the combustion cylinder 10 and may close the surrounding clearance. As shown at FIG. 1(*d*), on the other hand, there may be formed a bulge 54 for eliminating the turbulence of air to flow along the inner wall of the flow ring 20 and thereby smooth the flow. The aforementioned opening ratio is preferred to fall within the range of 40% to 60%, as specified above, because the straightening effect is weakened if it is excessively large and because the pressure loss is augmented if it is excessively small.

As described above, the first embodiment is constructed such that the flow ring 20, the porous plate 50 and the rib 51 are disposed in the combustor. As a result, the air flows smoothly into the combustor and is straightened and freed from disturbances or vortexes so that combustion instability can be suppressed to reduce vibrations.

The coefficient of the pressure loss is generally expressed by $\zeta=\Delta P/(V_{av}^2/2g)$. Here $\Delta P$ designates a pressure difference between the inlet and the outlet, $V_{av}$ an average flow velocity and g the gravity. As compared with the prior art having neither the flow ring 20 nor the porous plate 50, pressure lose with only the flow ring 20 of the invention is about 30% for 100% of the prior art, and about 40% with only the porous plate 50 and the rib 51. With the flow ring 20, the porous plate 50 and the rib 51, therefore, the $\zeta$is about 70%, so that the pressure loss is made considerably lower than that in the prior art.

Figure 2:
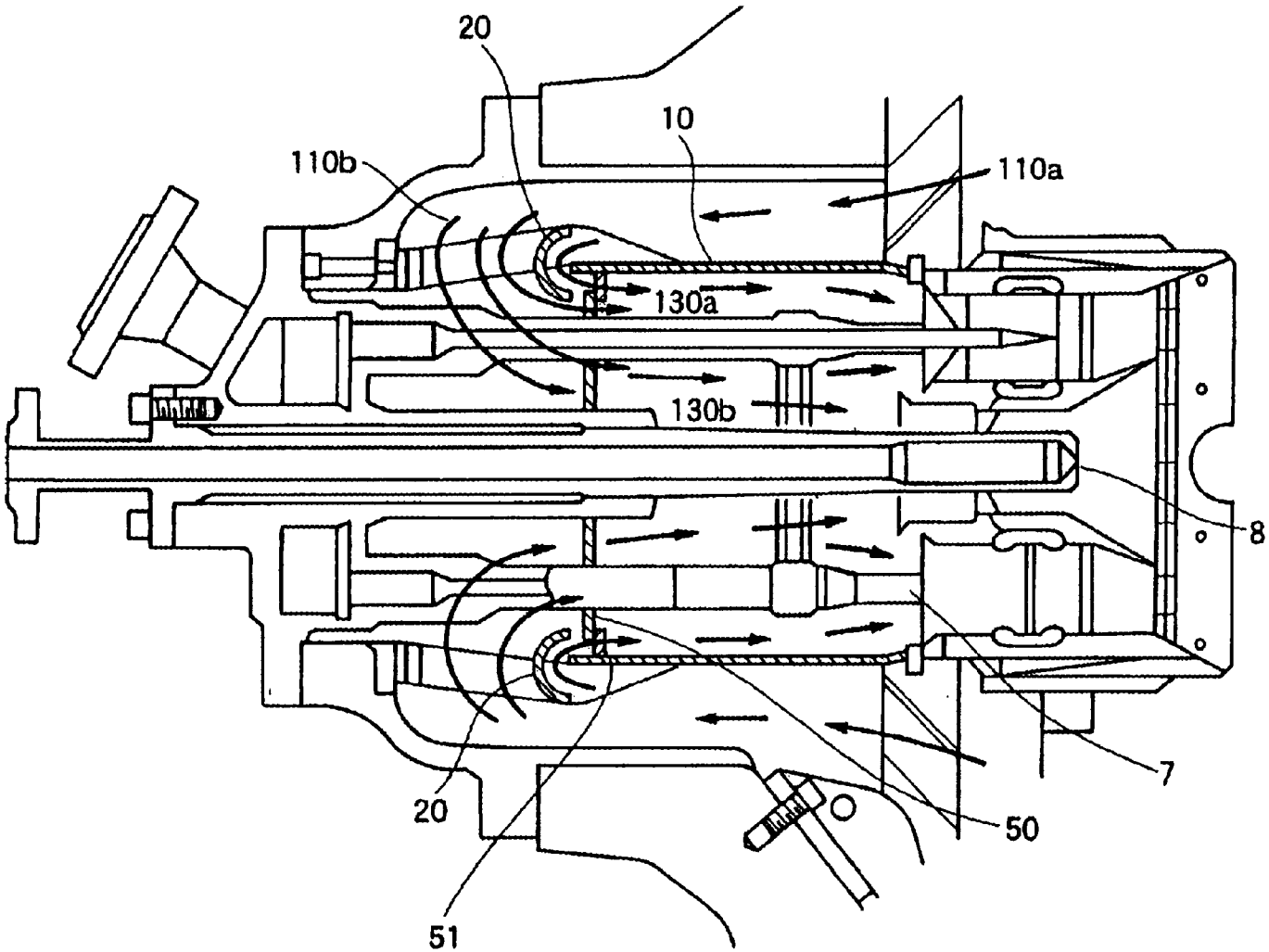
FIG. 2 is a diagram showing air flow of the gas turbine combustor according to the first embodiment of the invention.

FIG. 2 is a diagram showing air flows of the combustor according to the first embodiment thus far described. With the flow ring 20, the porous plate 50 and the rib 51, as shown, an incoming air flow 110*a* flows in and turns smoothly, as indicated by 110*b*, along the smooth curve of the flow ring 20 and further flows around main nozzles 7 and pilot nozzle 8, as indicated by 130*a* and 130*b*, without vortexes or disturbances. As a result, the fuel concentration is not varied and the flow is homogenized due to the straightening effect of the porous plate 50 and the rib 51, so that combustion instability hardly occurs.

Figure 3B:
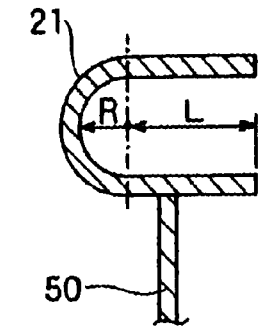
FIG. 3(*a*) is a sectional view of a gas turbine combustor according to a second embodiment of the invention and FIG. 3(*b*) is a detail thereof.
Figure 3A:
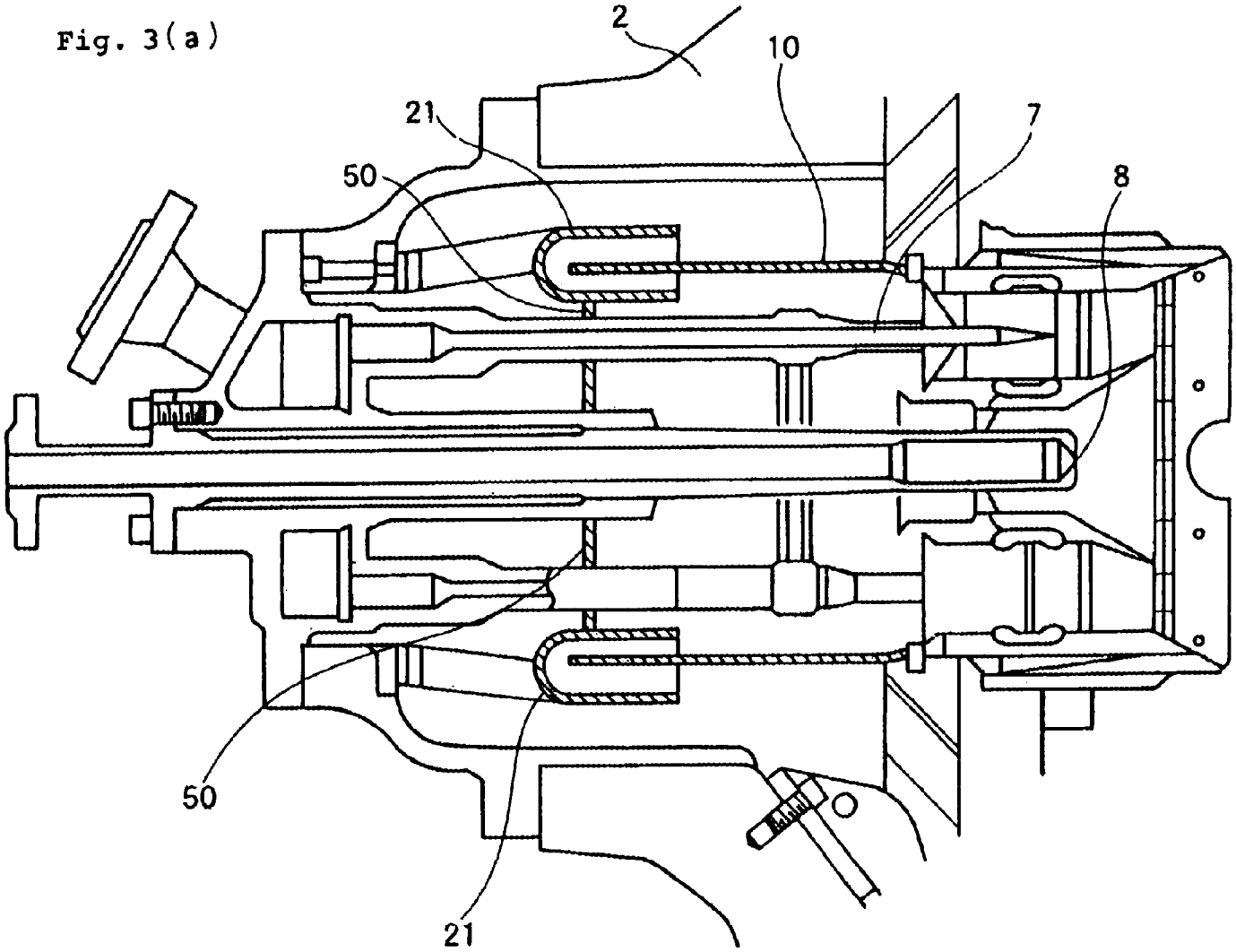

FIG. 3 show the inside of a gas turbine combustor according to a second embodiment of the invention, wherein FIG. 3(*a*) is a sectional view of the combustor and FIG. 3(*b*) is a sectional view of the flow ring. In FIG. 3, numeral 21 designates a flow ring which is formed not to have a semicircular section, as with the flow ring 20 of the first embodiment shown in FIGS. 1 and 2, but to have an extended semicircular shape having a width of an internal diameter R and an enlarged length L. In this second embodiment, the porous plate 50 is fixed at its circumference on the extended side face of the flow ring 21 so that the rib 51 used in the first embodiment can be dispensed with. The remaining construction is identical to that of the first embodiment shown in FIGS. 1 and 2, so that effects similar to those of the first embodiment can be attained to reduce combustion instability.

Figure 4:
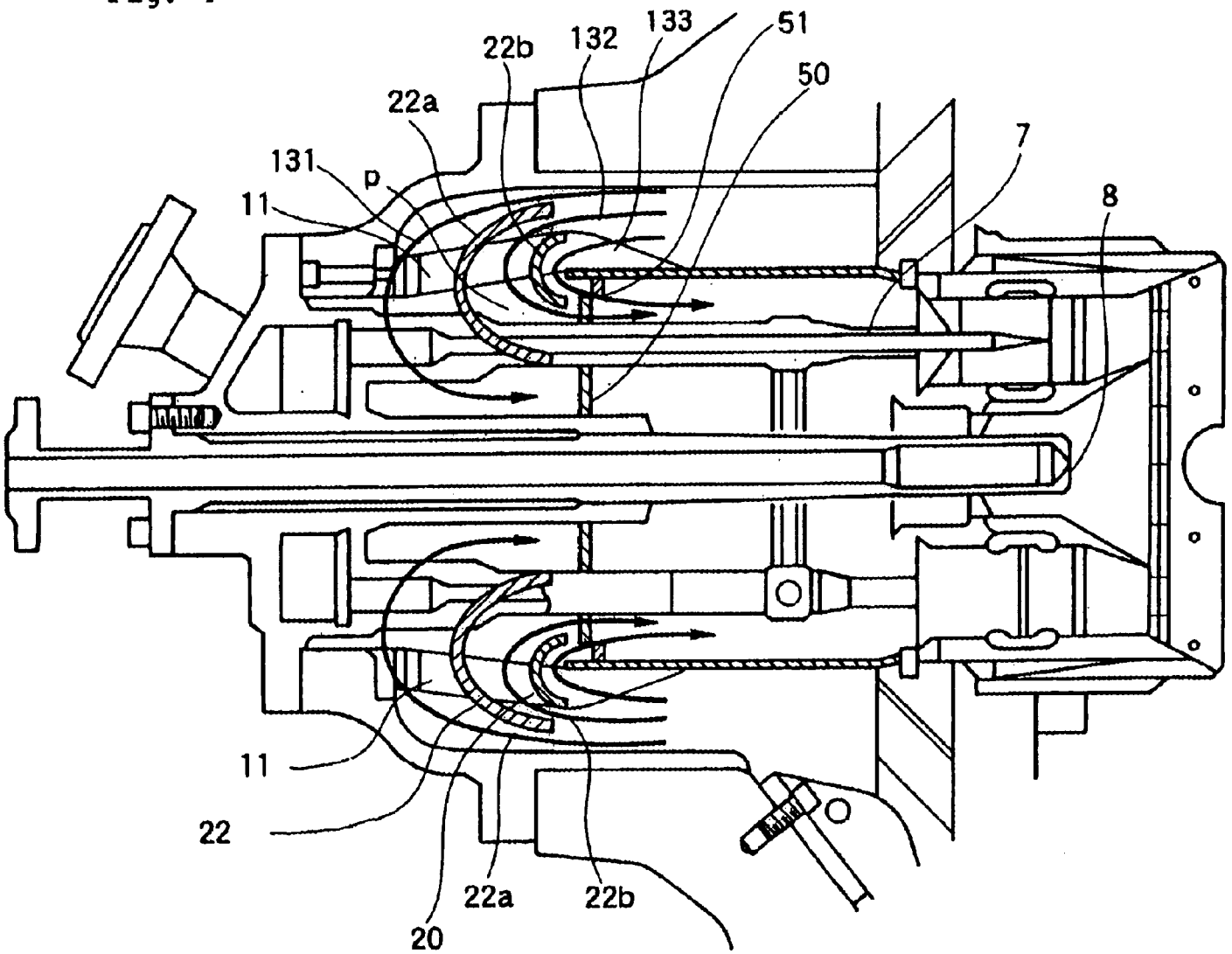
FIG. 4 is a sectional view of a gas turbine combustor according to a third embodiment of the invention.

FIG. 4 is a sectional view of the inside of a gas turbine combustor according to a third embodiment of the invention. In this third embodiment, as shown, a two-stage type flow ring 22 is adopted in place of the flow ring 20 of the first embodiment shown in FIGS. 1 and 2. The remaining construction has a structure identical to that of the first embodiment.

In FIG. 4, the flow ring 22 is constructed by arranging two stages of flow rings 22*a* and 22*b* of a semicircular section holding a passage P of a predetermined width. In this case, the air is guided to flow in as an air flow 131 along the upper face of the flow ring 22*a* on the outer side, an air flow 132 through the passage P formed between 22*a* and 22*b*, and an air flow 133 inside of 22*b*. These air flows are individually straightened by the porous plate 50 and a rib 51 so as to flow around the main nozzles 7 and the pilot nozzle 8 without vortexes or disturbances toward the leading end.

Figure 5A:
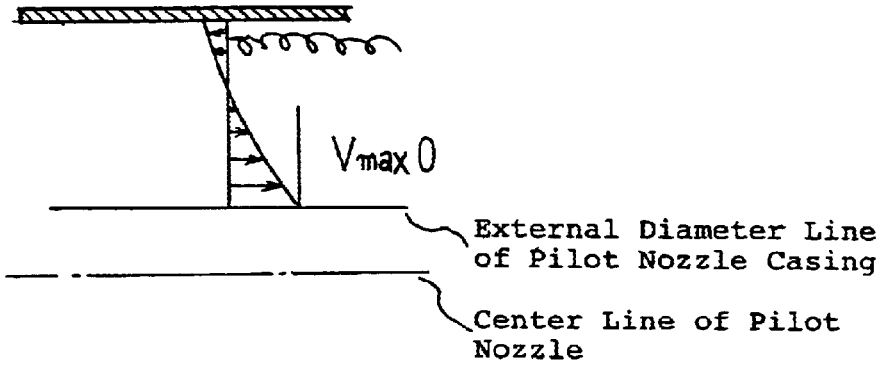
FIGS. 5(*a*)–(*c*) illustrate effects of the third embodiment of the invention, wherein FIG. 5(*a*) is a velocity distribution of the first embodiment, FIG. 5(*b*) is a velocity distribution of the second embodiment, and FIG. 5(*c*) is a velocity distribution of the third embodiment.
Figure 5B:
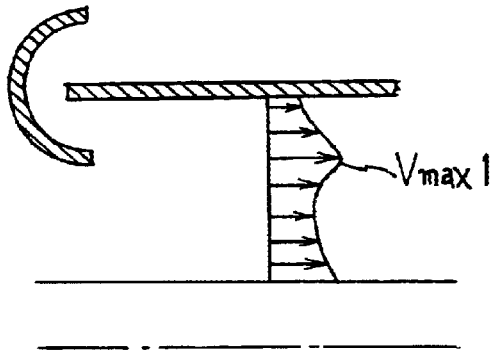
Figure 5C:
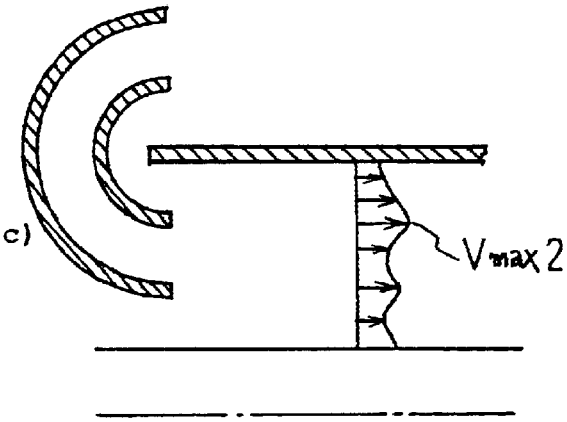

FIGS. 5(*a*)–(*c*) illustrate comparisons of the flows at the flow ring 20 of the first embodiment of the invention and the flows at the flow ring 22 of the third embodiment. FIG. 5(*a*) is with no flow ring, FIG. 5(*b*) with no flow ring, the velocity distribution has largely drifted toward the inner circumference. In FIG. 5(*b*), the velocity distribution fluctuates, as indicated by $V_{max}$1, at the entrance of the main passage, but in FIG. 5(*c*), the velocity distribution $V_{max}2$ is reduced ($V_{max}0>V_{max}1>V_{max}2$). By adopting the two-stage type flow ring 22, as in the third embodiment of FIG. 5(*c*), the fluctuation of the flow velocity is reduced, enhancing the effects.

Figure 6:
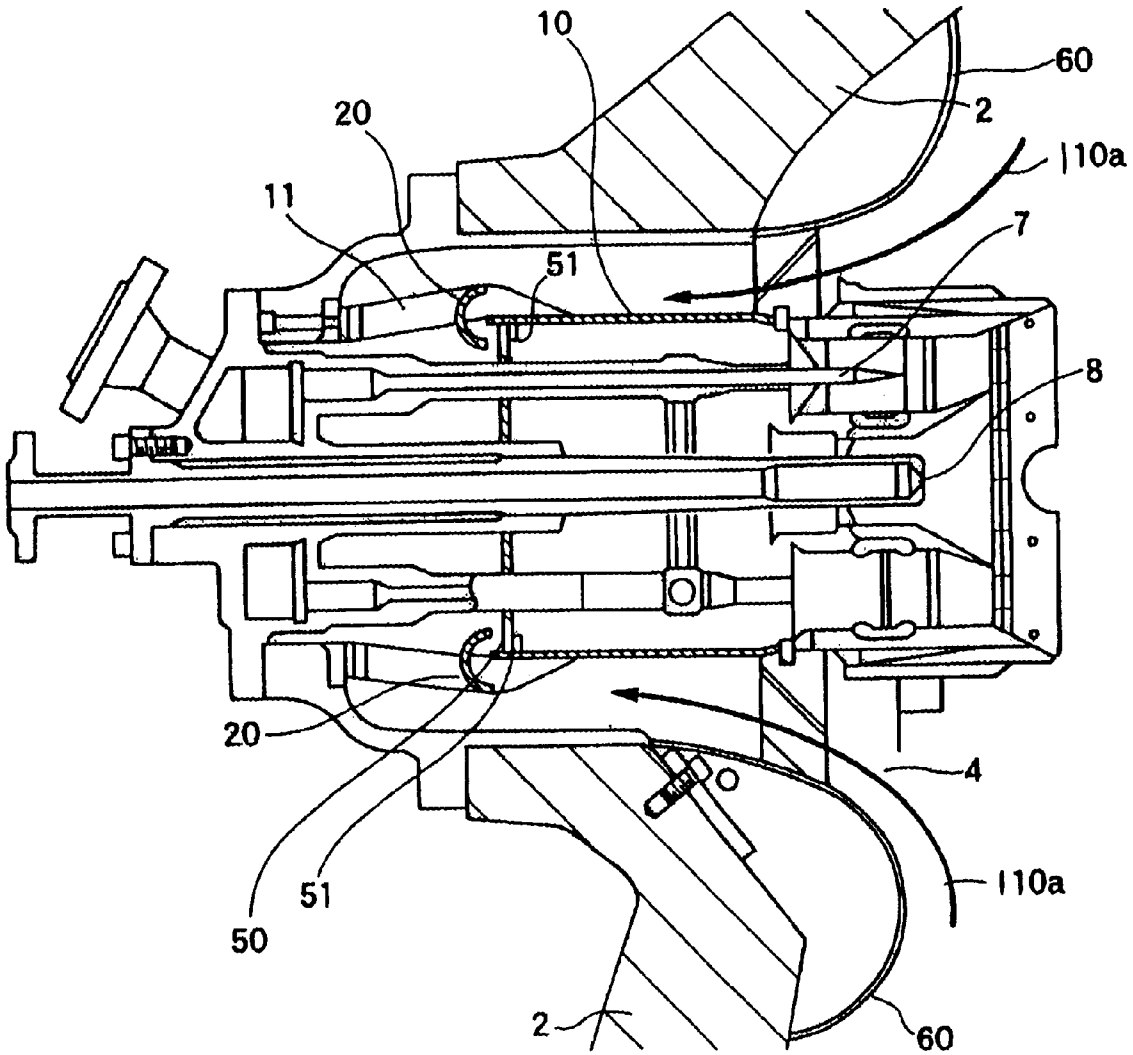
FIG. 6 is a sectional view of a gas turbine combustor according to a fourth embodiment of the invention.

FIG. 6 is a sectional view of a gas turbine combustor according to a fourth embodiment of the invention. In FIG. 6, the flow ring 20 is identical to that of the first embodiment shown in FIGS. 1 and 2. In this fourth embodiment, moreover, a bellmouth 60 is disposed around the wall of a turbine casing 2 of an inlet passage 4 of the combustor.

In the first embodiment, without the bellmouth 60, shown in FIGS. 1 and 2, the inner wall face of the turbine casing 2 around the combustor inlet passage 4 abruptly changes so that vortexes easily form on the surrounding wall face. In this fourth embodiment, the bellmouth 60 is provided to form the surroundings of the inlet passage 4 into a smoothly curved face so that the air inflow 110*a* comes in smoothly along the bellmouth 60 and is guided to the flow ring 20. In the inflow process, therefore, disturbances are eliminated which might otherwise be caused by the separation of flow on the wall face. In this fourth embodiment, too, there is attained the effect of reducing combustion instability as in the first embodiment.

Figure 7:
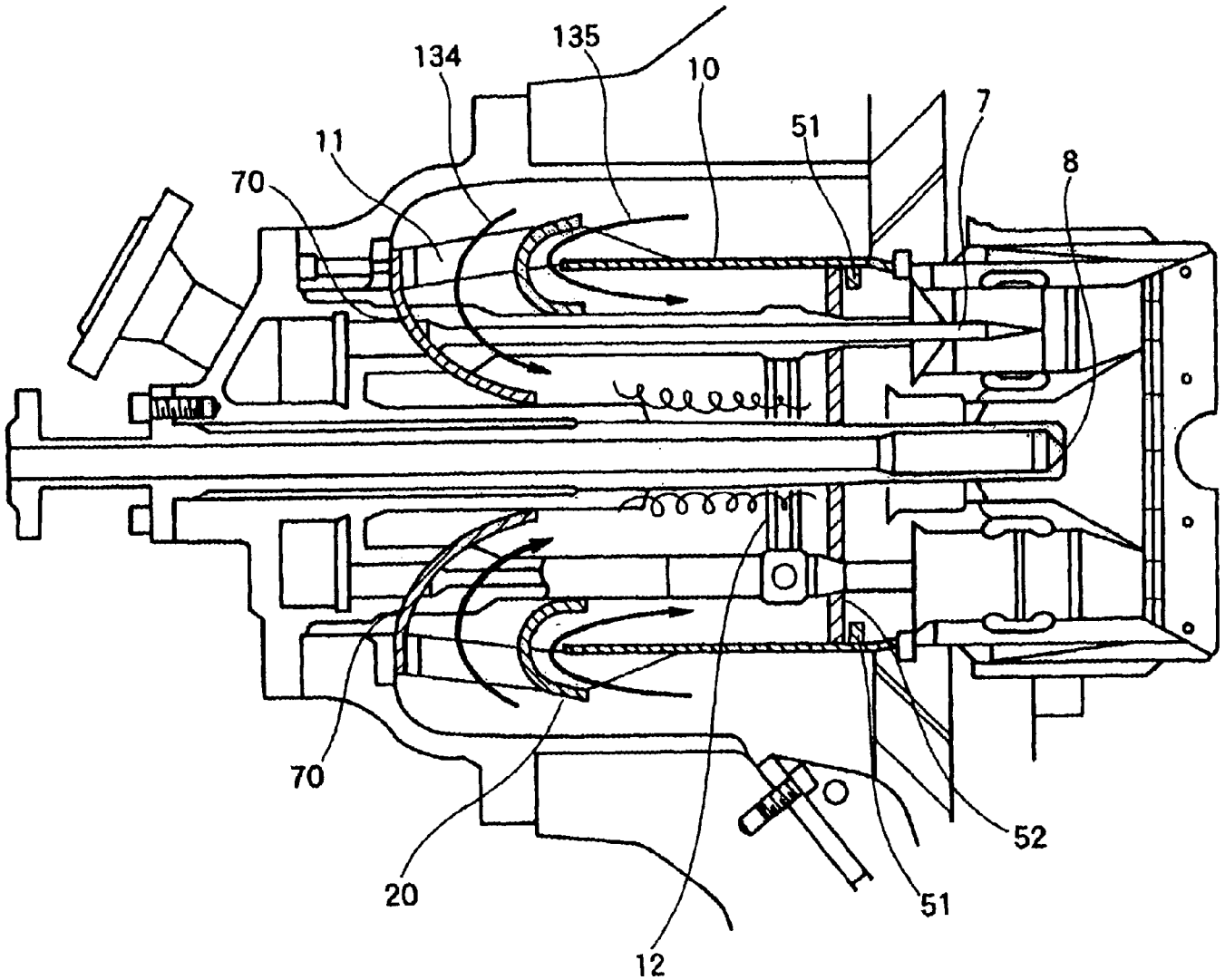
FIG. 7 is a sectional view of a gas turbine combustor according to a fifth embodiment of the invention.

FIG. 7 is a sectional view of a gas turbine combustor according to a fifth embodiment of the invention. In FIG. 7, the flow ring 20 is identical to that shown in FIGS. 1 and 2. In this fifth embodiment, the porous plate is disposed as a downstream porous plate 52. On the downstream side of a support 12 supporting the main nozzles 7 and the pilot nozzle 8, more specifically, is disposed the porous plate 52 for reducing the disturbances in the air flow, as might otherwise be caused by the support 12, so as to feed homogenous air flow to the leading end. The rib 51 is also provided, as in FIGS. 1 and 2.

On the upstream side, there is further provided an inner cylinder flow guide 70. This inner cylinder flow guide 70 has a funnel shape with an enlarged portion fixed at its circumference on the inner wall of the combustor leading end portion of the turbine casing 2 so as to have a smoothly curved face in the flow direction. A reduced portion is fixed around the pilot nozzle. As a result, the inner cylinder flow guide 70 and the curved face of the flow ring 20 form air inflow passage, along which the air smoothly flows in, as indicated by 134. The air also flows in, as indicated by 135, along the circular shape of the flow ring 20 on the inner side of the flow guide 20. The air inflow establishes, more or less, disturbances when it passes through the support 12, but is straightened by the porous plate 52 on the downstream side so that it can flow as a homogeneous flow to the leading end portion to thereby reduce combustion instability as in the first embodiment. In the fifth embodiment, too, there is attained the effect of remarkably reducing combustion instability, as with the first embodiment.

Figure 8:
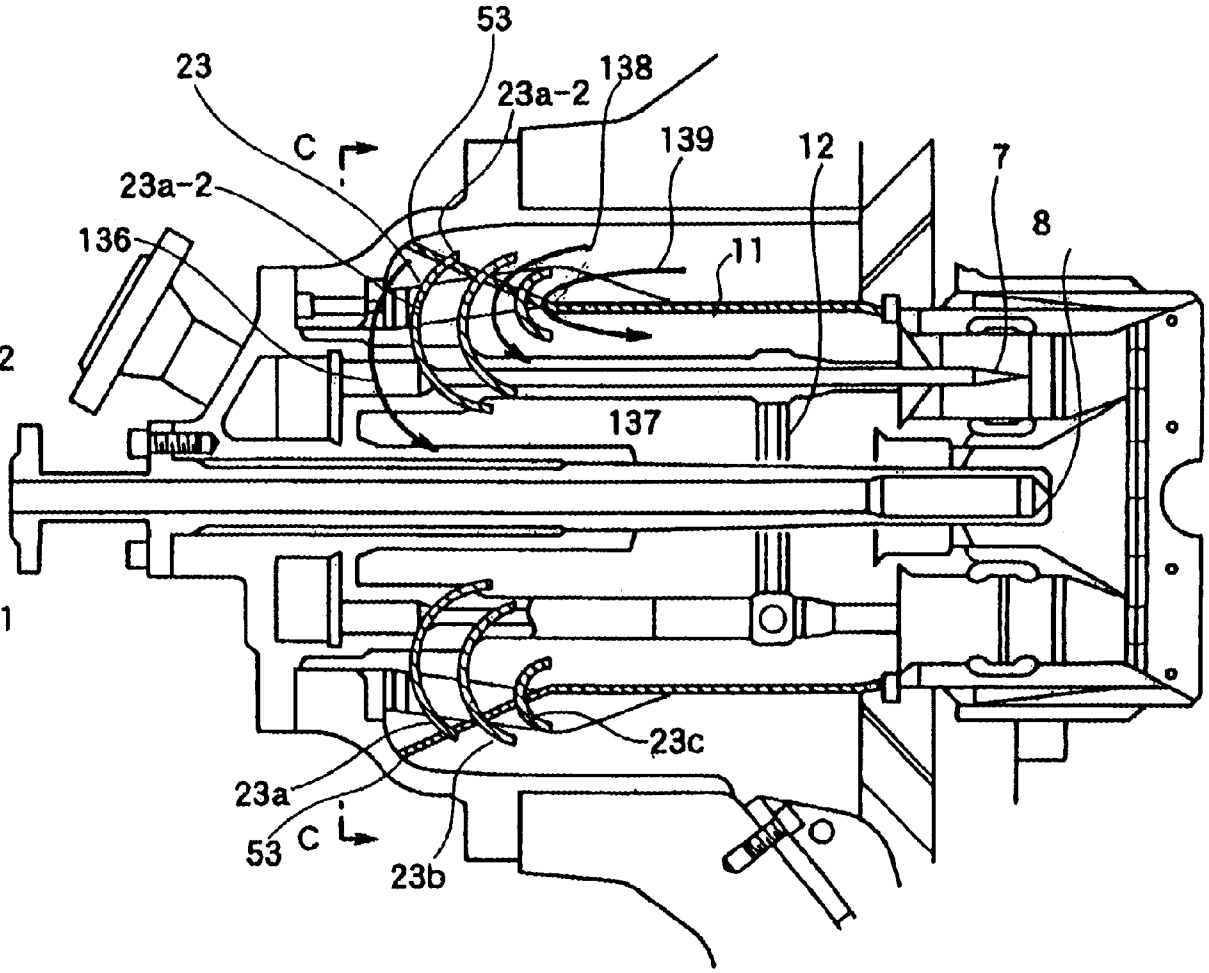
FIGS. 8(*a*)–(*b*) show a gas turbine combustor according to a sixth embodiment of the invention, wherein FIG. 8(*a*) is a sectional view, and FIG. 8(*b*) is a sectional view taken along line C—C in FIG. 8(*a*).
Figure 8:
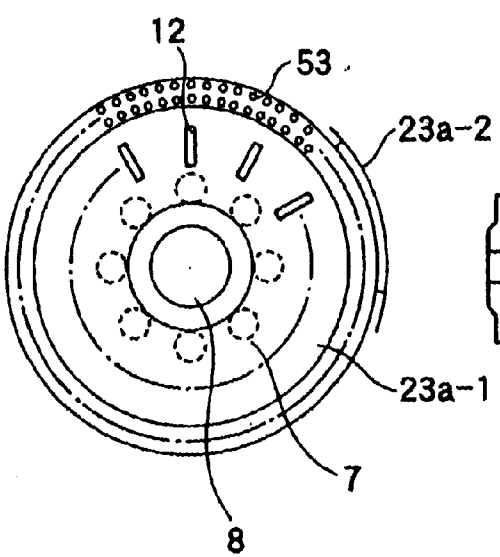

FIG. 8 shows a gas turbine combustor according to a sixth embodiment of the invention in which FIG. 8(*a*) is a sectional view, and FIG. 8(*b*) is a sectional view along line C—C in FIG. 8(*a*). In this sixth embodiment, the flow ring is formed into a multistage flow ring 23 so that the air inflow may come smoothly at the upstream inlet to reduce the flow disturbances the inside. The multistage flow ring 23 is constructed, as shown, by arranging an outer one 23*a,* an intermediate one 23*b* and an inner one 23*c* while maintaining predetermined passages inbetween. These flow rings 23*a,* 23*b* and 23*c* are individually fixed on the struts 11. In the inlet portion, there is further arranged a porous plate 53, which has a diverging cylindrical shape such that its enlarged portion is fixed on the inner wall of the turbine casing and its other end is connected to the end portion of the combustion cylinder 10.

The flow ring 23 is halved, as represented by 23*a* in FIG. 8(*b*), at the leading circumferential portion of the porous plate 53 into a larger arcuate portion 23*a*-1 on the inner side and a portion 23*a*-2 on the outer circumferential side. The remaining flow rings 23*b* and 23*c* are given similar constructions. The porous plate 53 is preferably constructed to have an opening ratio of 40% to 60%, as in the first embodiment shown in FIGS. 1 and 2. In this sixth embodiment, on the other hand, the porous plate rib can be dispensed with.

In the combustor thus constructed, the air inflow is guided in four flows, as indicated by 136, 137, 138 and 139, by the flow rings 23*a,* 23*b* and 23*c* and are straightened at the inlet by the multiple pores of the porous plate 53. The air flows then turns smoothly along the individual partitioned passages and enters the inside. As a result, the air flow is homogeneously divided into the four flows and straightened just before they turn, so that their downstream flows are hardly disturbed, reducing combustion instability.

Figure 9:
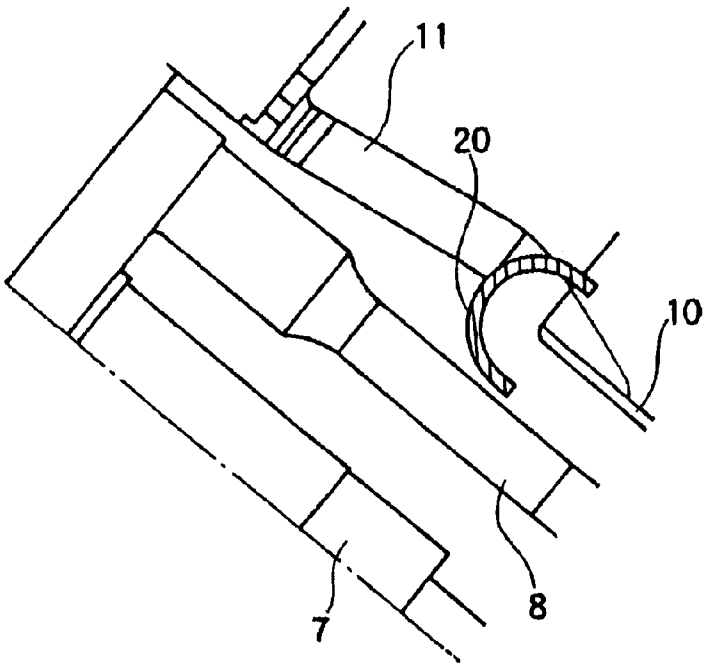
FIGS. 9(*a*)–(*b*) show a gas turbine combustor according to a seventh embodiment of the invention, wherein FIG. 9(*a*) is a sectional view of the entirety, and FIG. 9(*b*) is a detailed view of portion D in FIG. 9(*a*).
Figure 9A:
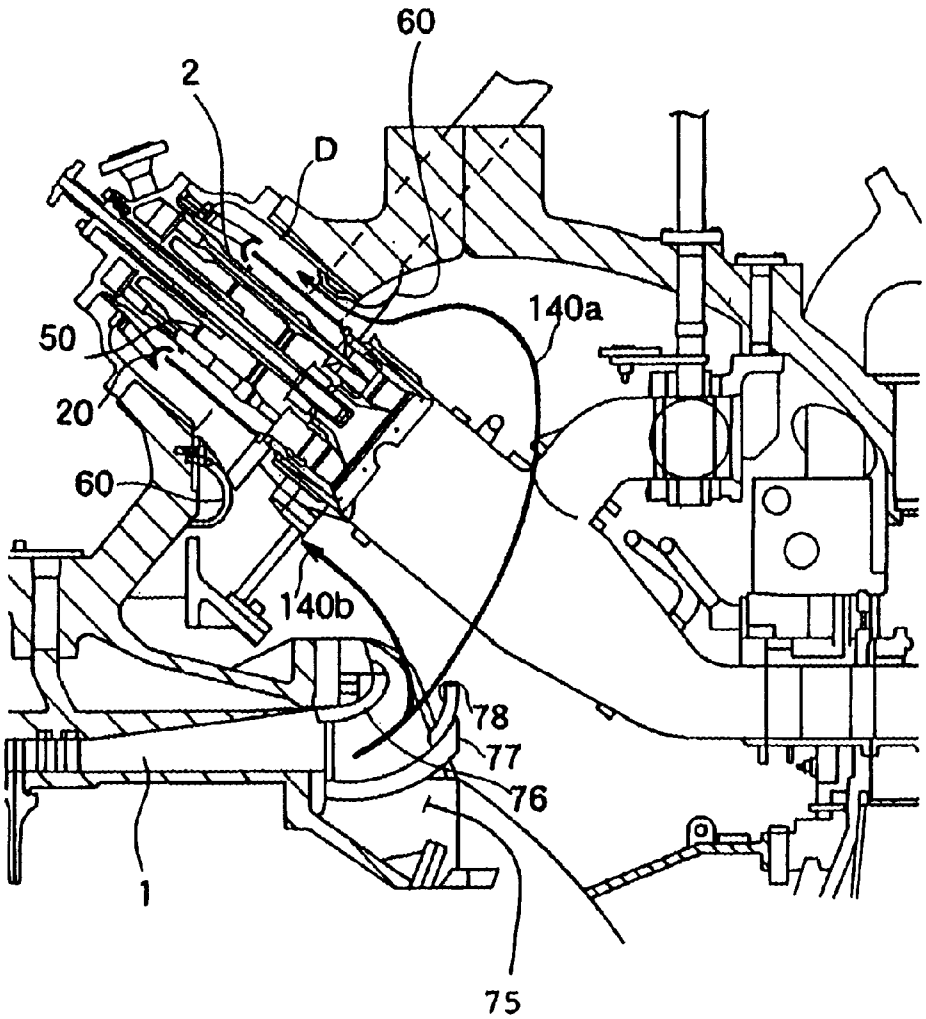

FIG. 9 shows a gas turbine combustor according to a seventh embodiment of the invention, wherein FIG. 7(*a*) is an entire view, and FIG. 7(*b*) is a partially sectional view of a flow ring of the combustor. In this seventh embodiment, the combustor inlet is provided with a bellmouth 60, the combustor is provided with a flow ring 20 and a porous plate 50, and the compressor outlet is provided with a compressor outlet flow guide, so that the air to flow into the combustor is hardly disturbed and may be homogenized to reduce the combustion instability.

First of all, in FIG. 9(*a*), the inlet passage bellmouth 60 is disposed around the inlet, and the porous plate 50 is disposed in the combustor, as has been described with reference to FIG. 6. FIG. 9(*b*) shows the flow ring 20 having a semicircular section, as has been described with reference to FIG. 1. To the outlet of a compressor 1, moreover, there is connected a compressor outlet flow guide 75 which is opened to guide the air outward around the rotor from the compressor outlet toward a plurality of combustors on the outer side. On the opening portions of the flow guide 75, there are mounted ribs 76, 77 and 78 which are spaced at a predetermined distance for maintaining proper strength.

In the seventh embodiment thus constructed, the air from the compressor outlet is guided to flow homogeneously, as indicated by 140*a* and 140*b,* toward the surroundings of the combustor 2 by the guidance of the compressor outlet flow guide 75, and is further guided to flow smoothly into the combustor by the bellmouth 60 at the combustor inlet. In the combustor, the flow direction is smoothly turned by the flow guide 20 and is straightened by the porous plate 50 so the air is fed, without any disturbance, to the main nozzles 7 and to the surroundings of the pilot nozzle 8. In this seventh embodiment, the guide 75, the bellmouth 60 and the flow ring 20 for guiding the flows smoothly are disposed at the outlet of the compressor 1, the inlet of the combustor and in the combustor. As a result, the combustion air flow can be homogenized, while its drift is suppressed, suppressing fluctuations in fuel concentration to a low level so that combustion instability can be further reduced.

Figure 10A:
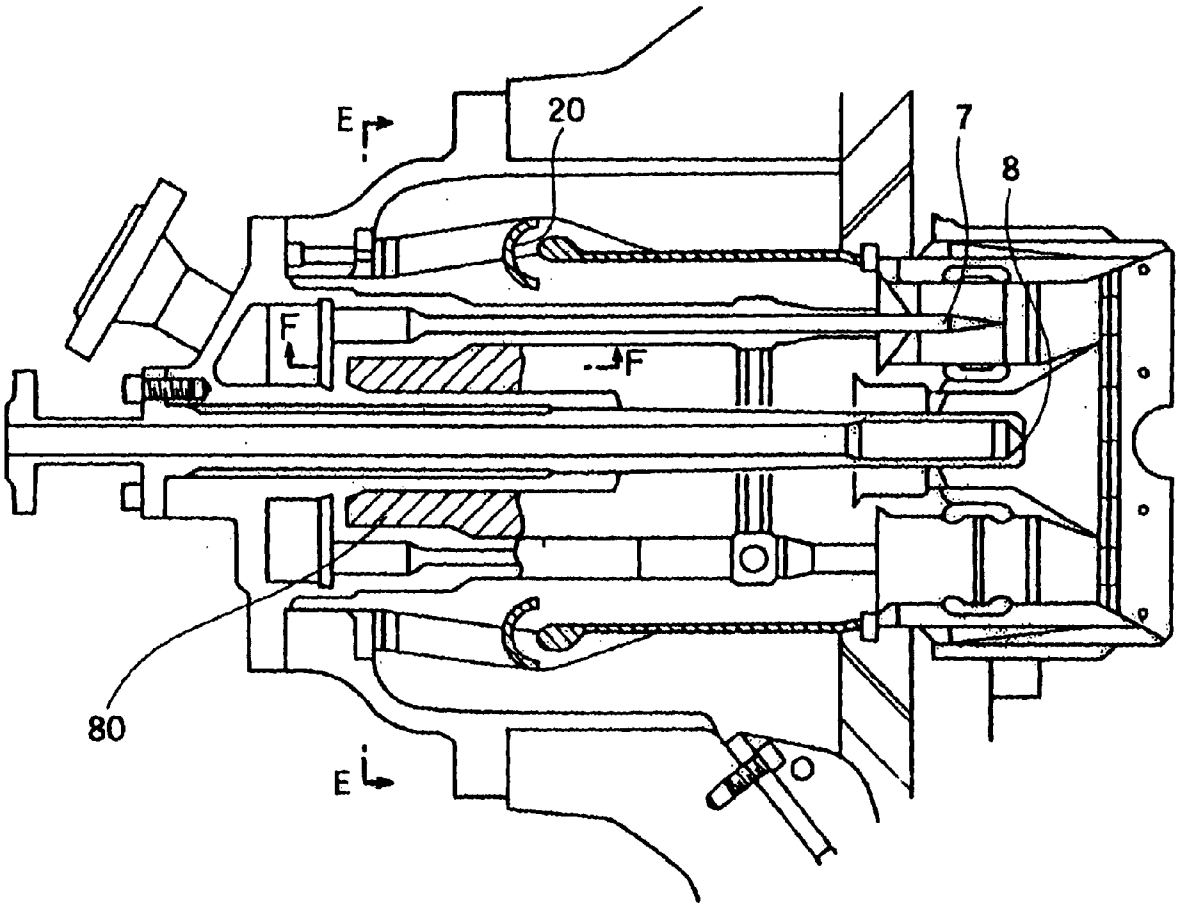
FIG. 10 show a gas turbine combustor according to an eighth embodiment of the invention, wherein FIG. 10(*a*) is a sectional view, and FIG. 10(*b*) is a sectional view of E—E in FIG. 10(*a*).
Figure 10B:
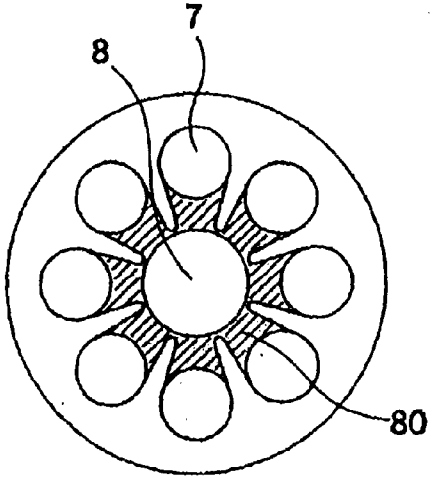
Figure 11:
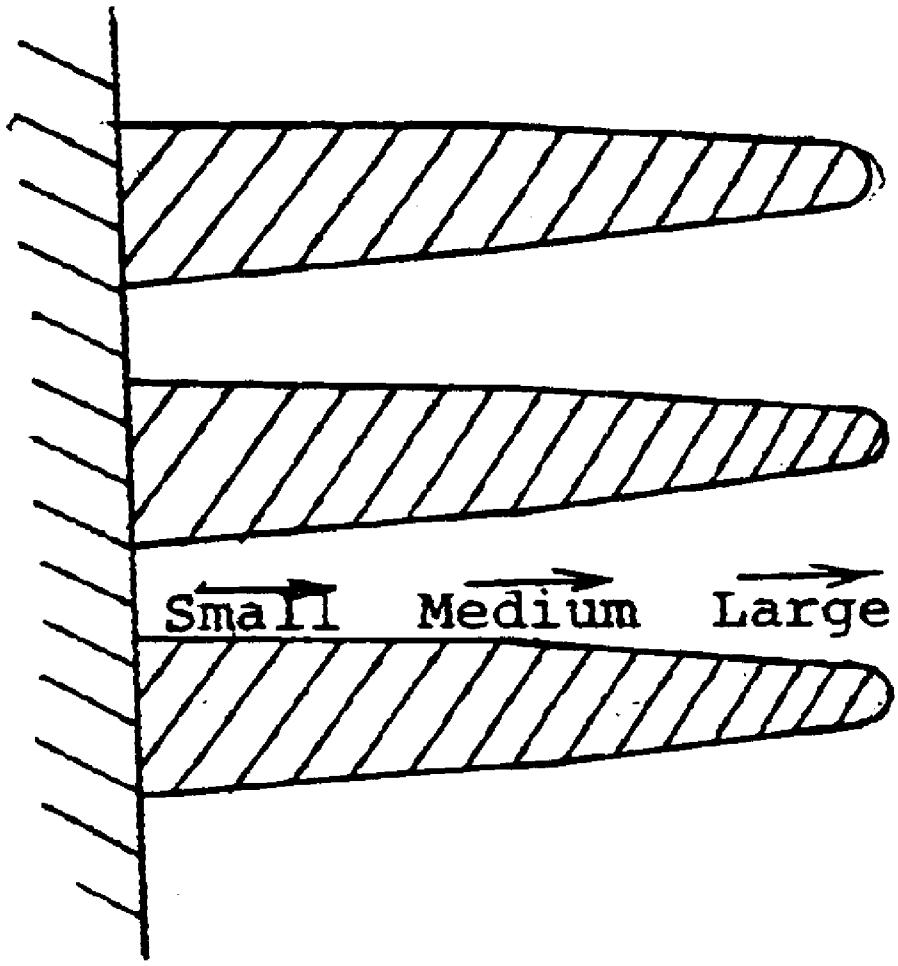
FIG. 11 is a sectional view taken along line F—F in FIG. 10(*a*) and shows a development in the circumferential direction.

FIG. 10 show a gas turbine combustor according to an eighth embodiment of the invention, wherein FIG. 10(*a*) is a sectional view of the combuster, and FIG. 10(*b*) is a sectional view taken along line E—E in FIG. 10(*a*). FIG. 11 is a sectional view taken along line F—F of FIG. 10(*a*) and shows a development in the circumferential direction. In FIG. 10, the combustor is provided with the flow ring 20 as in FIGS. 1 and 2. In this eighth embodiment, moreover, fairings 80 made of a filler are disposed in a predetermined section upstream of the pilot nozzle 8 and the eight main nozzles arranged in a circumferential shape.

The fairings 80 are formed, as shown in FIG. 10(*b*), by filling the space, as hatched, between the main nozzles 7 and the pilot nozzle 8. The fairings 80 are elongated in the longitudinal direction to the vicinity of the leading end portion of the flow ring 20 and the combustion cylinder 11 so that a downstream side is made thinner than an upstream side 80*a,* as shown in FIG. 11, and so that a gap between the adjoining fairings is enlarged in the downstream direction. The reason for this shape is that the air flow velocity grows higher toward the downstream end from the upstream end so that the flow may be smoothed to reduce disturbances of the flow velocity by making the width of the space larger toward the downstream side.

In the eighth embodiment thus constructed, the air inflow will turn in the combustor and will flow through the gap between the main nozzles 7 and the pilot nozzle 8 downstream of the upstream end of the fairings 80. However, this gap is filled with the fairings 80. As shown in FIGS. 10(*b*) and 11, therefore, the gap is enlarged at the leading end portion between the adjoining main nozzles 7. As the flow velocity rises higher, therefore, the passage is enlarged to smooth the air flow so that the air flows along the surroundings of the pilot nozzle 8 and flows out of the leading end portion.

On the other hand, the air from the outside of the main nozzles 7 turns smoothly at the flow ring 20, as in the first embodiment described with reference to FIG. 1, and flows in. Therefore, the disturbances to the air flow upstream around the main nozzles 7 and around the pilot nozzle 8 are minimized so that it can be fed as a homogenous air flow to the nozzle leading end portion so as to reduce combustion instability.

Figure 12:
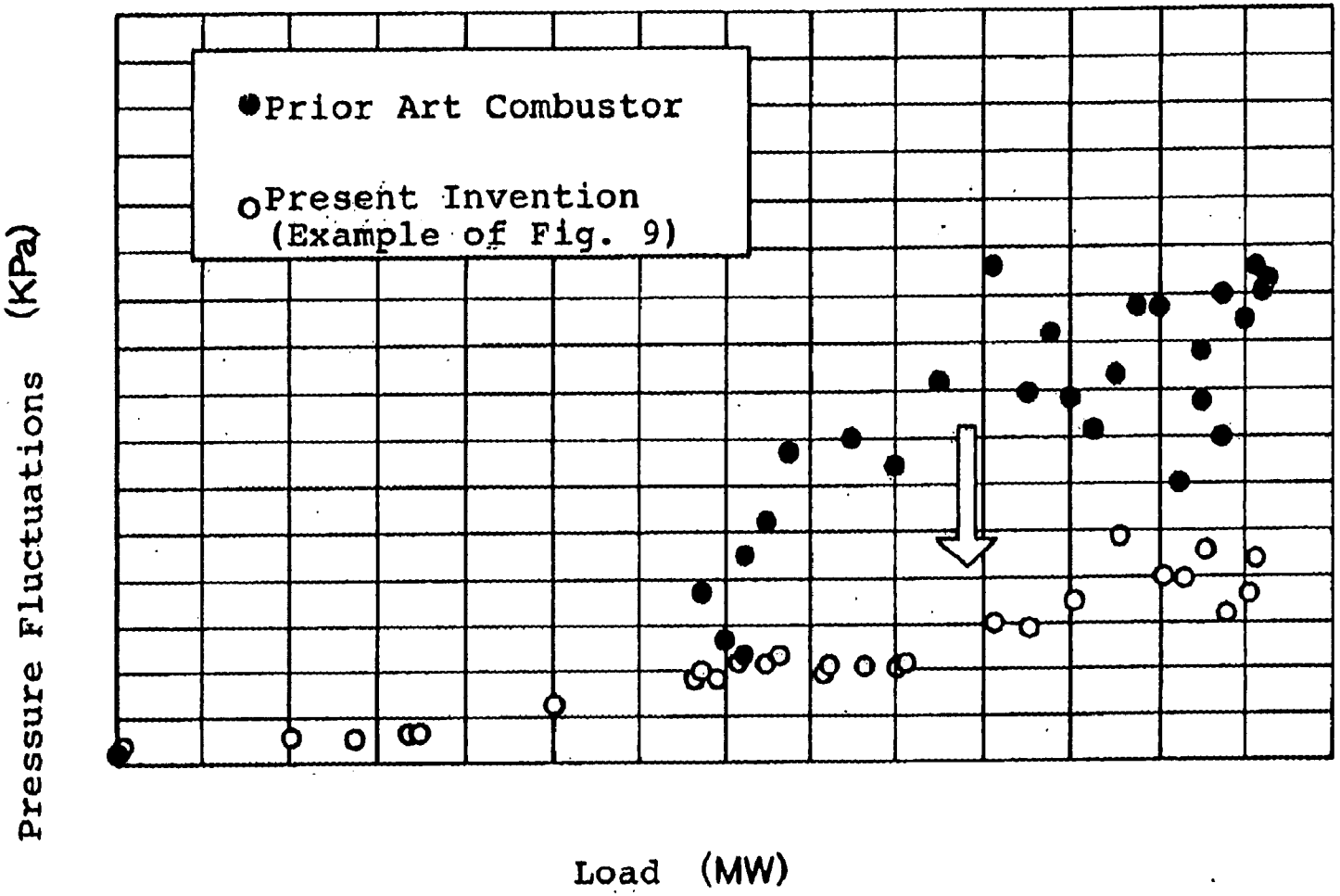
FIG. 12 is a diagram illustrating the effects of the invention.
Figure 13:
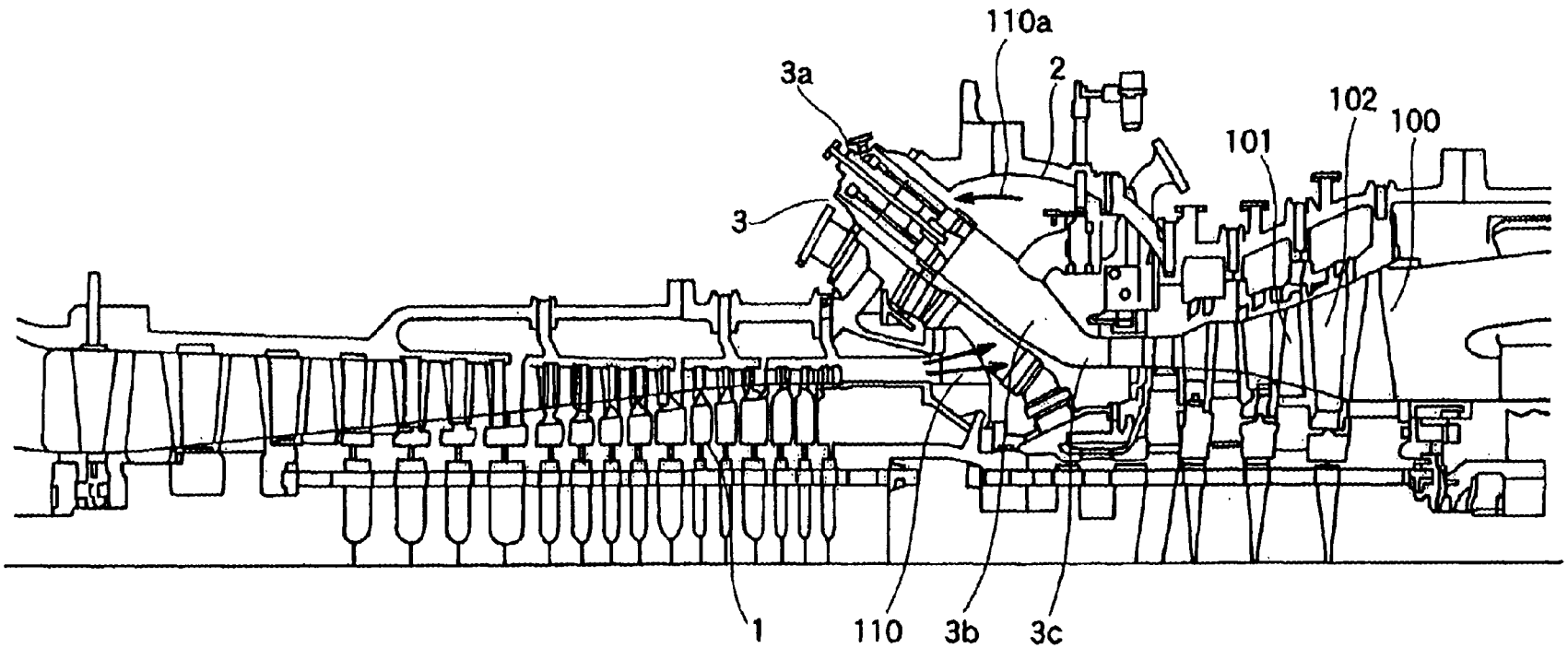
Fig. 13 PRIOR ART
FIG. 13 is an entire sectional view of a general gas turbine.

FIG. 12 is a diagram illustrating the effects of the invention. The experimental values of the seventh embodiment, as has been described with reference to FIG. 9, are representatively plotted. The abscissa indicates a load, whereas the ordinate indicates air pressure fluctuations of the combustor. In FIG. 12, black circles indicate the data of the combustor of the prior art, and white circles indicate the data of the case in which there are provided the flow guide 20, the porous plate 50, the porous plate rib 51 and the compressor outlet flow guide 75 as shown in the FIG. 9. As illustrated, it is found that the air pressure fluctuations are reduced if the flow guide 20, the bellmouth 60 and the compressor inlet guide 75 are provided in addition to the porous plate.

In the gas turbine combustor of the invention (1), the air to flow in the combustor flows at first smoothly along the curved face of the flow ring in the cylinder and then passes through the numerous pores of the porous plate so that it is straightened into a homogeneous flow. With neither separation vortexes nor flow disturbances, unlike the prior art, the air flows along the pilot nozzle and the main nozzles to the leading end portion so that combustion instability, as might otherwise be caused by concentration differences of the fuel, can be reduced.

In the invention (2), the flow ring is formed into an extended semicircular shape, and the porous plate can be fixed at its periphery on the extended elliptical side face so that manufacture can be facilitated. In the invention (3), on the other hand, the flow rings are arranged in multiple stages so that the air is homogeneously guided to flow into the cylinder of the combustor through the multistage circumferential gaps, thereby better promoting the effects of the aforementioned invention (1).

In the invention (4), the inlet portion of the combustor housing portion is constructed of wall faces having corners protruding are housing portion. The air flow into the combustor is disturbed and is guided in a turbulent state into the flow guide of the leading end portion of the combustor. However, a guide portion is provided so that the wall face of the inlet portion may form a smoothly curved face. With this guide portion, the air inflow can be prevented from being disturbed, ensuring the effect of reducing combustion instability of the aforementioned invention (1).

In the invention (5), the air inflow is smoothly turned at the upstream end of the combustor by the funnel-shaped flow guide and is guided into the cylinder by the flow ring. Moreover, the porous plate is disposed downstream of the support for supporting the pilot nozzle and the main nozzles. Even if the flow is disturbed, more or less, by the support, therefore, these disturbances are straightened by the porous plate so that the air flow in homogenized and introduced into the nozzle leading end portion to thereby better ensure the effect of reducing combustion instability of the aforementioned invention (1).

In the invention (6), the flow rings are arranged in multiple stages, and the cylindrical porous plate is arranged in front of the air inlet portion around those flow rings. Therefore, the air to flow into the combustor is straightened into cylindrical homogeneous flow by the porous plate. This homogeneous flow is then smoothly guided through the gap between the multistage flow rings into the cylinder of the combustor.

In the invention (7), in the space between the individual main nozzles and the pilot nozzle opposed to each other, there is formed the fairings so that the air flows in the gaps between the adjoining fairings and further flows downstream. This air flow has a downwardly rising flow velocity. Therefore, the gap is enlarged from upstream to downstream so that the air flow through the fairings is homogenized by that shape. Thus, the air can flow downstream without any flow disturbance to thereby reduce combustion instability as might otherwise be caused by such disturbances.

In the invention (8), there is disposed at the compressor outlet the flow guide for guiding the air flow from the compressor outlet to the combustor homogeneously around the combustor. In the combustor, there are disposed the flow ring and the porous plate to eliminate the air disturbances in the combustor and to reduce the combustion instability. Moreover, the air to flow in the combustor is guided to flow smoothly at the inlet portion of the combustor housing portion by the guide portion of the smooth curve. As a result, there can be realized a gas turbine which can reduce the pressure loss in the air flow and can reduce the combustion instability.

What is claimed is:

1. A gas turbine combustor comprising:

a cylinder circumferentially supported by a plurality of struts fixed at one end to a combustor housing portion of a turbine casing, said cylinder having a center;

a pilot nozzle at the center of said cylinder;

a plurality of main nozzles around said pilot nozzle;

a flow ring having a ring shape and a semicircular cross sectional shape and disposed so as to cover an upstream end of said cylinder which is upstream with respect to a direction of flow inside said cylinder and in said pilot nozzle and said main nozzles while maintaining a predetermined gap with said upstream end; and a porous plate downstream of said flow ring in a space formed between said pilot nozzle and said main nozzles;

wherein said semicircular cross sectional shape of said flow ring further comprises two ends of a semicircle defining said semicircular cross sectional shape being extended so as to form an extended semicircular cross sectional shape having a side face, and wherein said porous plate is fixed at a circumference thereof to said side face.

2. A gas turbine combustor comprising:

a cylinder circumferentially supported by a plurality of struts fixed at one end to a combustor housing portion of a turbine casing, said cylinder having a center;

a pilot nozzle at the center of said cylinder;

a plurality of main nozzles around said pilot nozzle;

a flow ring having a ring shape and a semicircular cross sectional shape and disposed so as to cover an upstream end of said cylinder which is upstream with respect to a direction of flow inside said cylinder and in said pilot nozzle and said main nozzles while maintaining a predetermined gap with said upstream end;

a porous plate downstream of said flow ring in a space formed between said pilot nozzle and said main nozzles; and a guide portion having a smoothly curved face and disposed around an inlet portion of the combustor housing portion of the turbine casing such that said smoothly curved face covers an entire circumference of a wall face of the inlet portion.

3. A gas turbine combustor comprising:

a cylinder circumferentially supported by a plurality of struts fixed at one end to a combustor housing portion of a turbine casing, said cylinder having a center;

a pilot nozzle at the center of said cylinder;

a plurality of main nozzles around said pilot nozzle;

a flow ring having a ring shape and a semicircular cross sectional shape and disposed so as to cover an upstream end of said cylinder which is upstream with respect to a direction of flow inside said cylinder and in said pilot nozzle and said main nozzles while maintaining a predetermined gap with said upstream end;

a porous plate downstream of said flow ring in a space formed between said pilot nozzle and said main nozzles; and a support for supporting said pilot nozzle and said main nozzles and a flow guide having a funnel shape and a cross sectional shape that is smoothly curved so as to extend along a curved face of said flow ring and upstream of said flow ring so as to maintain a predetermined gap with said flow ring, wherein said flow guide is fixed at a larger diameter portion on an inner wall of the combustor housing portion of the turbine casing and at a smaller diameter portion around said pilot combustor, and wherein said porous plate is downstream of said support for supporting said pilot nozzle.

4. A gas turbine combustor comprising:

a cylinder circumferentially supported by a plurality of struts fixed at one end to a combustor housing portion of a turbine casing, said cylinder having a center;

a pilot nozzle at the center of said cylinder;

a plurality of main nozzles around said pilot nozzle;

a first flow ring having a ring shape and a semicircular cross sectional shape and disposed so as to cover an upstream end of said cylinder which is upstream with respect to a direction of flow inside said cylinder and in said pilot nozzle and said main nozzles while maintaining a predetermined gap with said upstream end;

further flow rings individually having semicircular cross sectional shapes and disposed in multiple stages upstream of said first flow ring in an axial direction of said cylinder and having predetermined gaps with said first flow ring; and a cylindrical porous covering an entire circumference of an outer side inlet portion of said further flow rings and said first flow ring.

5. A gas turbine combustor comprising:

a cylinder having a center;

a pilot nozzle at the center of said cylinder, said pilot nozzle having a circumference;

a plurality of individual main nozzles around said pilot nozzle, said individual main nozzles confronting said pilot nozzle; and a filler filling spaces between said circumference of said pilot nozzle and said individual main nozzles and extending from an upstream end in an axial downstream direction near a circumferential portion of a leading end of said cylinder so as to form fairings;

wherein a passage between adjacent fairings is wider at a downstream end than at an upstream of said fairings.

6. A gas turbine comprising a compressor and a combustor, said combustor comprising:

a cylinder circumferentially supported by a plurality of struts fixed at one end to a combustor housing portion of a turbine casing, said cylinder having a center;

a pilot nozzle at the center of said cylinder;

a plurality of main nozzles around said pilot nozzle;

a flow ring having a ring shape and a semicircular cross sectional shape and disposed so as to cover an upstream end of said cylinder which is upstream with respect to a direction of flow inside said cylinder and in said pilot nozzle and said main nozzles while maintaining a predetermined gap with said upstream end; and a porous plate downstream of said flow ring in a space formed between said pilot nozzle and said main nozzles;

said compressor having an outlet;

wherein a flow guide is disposed around an entire circumference of said outlet of said compressor, said flow guide having a smoothly curved face for guiding air discharged from said compressor toward said combustor; and wherein a guide portion having a smoothly curved face is disposed around an inlet portion of the combustor housing portion of the turbine casing such that said smoothly curved face covers an entire circumference of a wall face of the inlet portion.

* * * * *